US007392776B1

(12) United States Patent
Lawson

(10) Patent No.: US 7,392,776 B1
(45) Date of Patent: Jul. 1, 2008

(54) ROCKER ARM CONSTRUCTION

(76) Inventor: Jackie L. Lawson, 1061 Painter Rd., Jonesborough, TN (US) 37659

( * ) Notice: Subject to any disclaimer, the term of this patent is extended or adjusted under 35 U.S.C. 154(b) by 0 days.

(21) Appl. No.: 10/983,938

(22) Filed: Nov. 8, 2004

(51) Int. Cl.
*F01L 1/18* (2006.01)

(52) U.S. Cl. ..... 123/90.39; 123/90.61; 74/559; 29/888.2

(58) Field of Classification Search ..... 123/90.16, 123/90.2, 90.39, 90.41, 90.44, 90.61, 90.63; 74/559, 567, 569; 29/888.2
See application file for complete search history.

(56) References Cited

U.S. PATENT DOCUMENTS 2,385,959 A * 10/1945 Yingling ..... 123/90.39
3,095,948 A * 7/1963 Lahr ..... 184/6.9
4,327,677 A * 5/1982 Vander Bok ..... 123/90.4

* cited by examiner

*Primary Examiner*—Ching Chang

(57) ABSTRACT

Disclosed is a unique configuration of a rocker arm per se wherein high stress areas thereof are strengthened and a trunion shaft is rotatively mounted on its push rod end and has a threaded push rod end insertion bore, a unique push rod construction per se wherein the upper end thereof is threaded, the combination of this rocker arm and the push rod wherein the upper end of the push rod is threaded into the insertion bore whereby the sudden, rapid, repeated and severe impact forces of the push rod end against the rocker arm are spread throughout the threaded connection and the rocker arm and are thus greatly diminished for each point of force contact between the push rod and the rocker arm, and further the stated combination mounted on an internal combustion engine.

14 Claims, 5 Drawing Sheets

Intake Rocker

ROCKER ARM CONSTRUCTION

BACKGROUND OF THE INVENTION

1. Field

This invention is in the field of internal combustion engines, particularly automotive engines having rocker arms and push rods and more particularly concerns that structural portion of a rocker arm which contacts the upper end of a push rod, and further concerns the push rod construction, per se and the combination of an internal combustion engine employing the present rocker arm and push rod.

2. Prior Art

Heretofore, the receiving socket for the upper end of a push rod of a typical internal combustion engine rocker arm has been a concave surface in which the rounded upper end of the push rod nests and which end can actually rotate about its longitudinal axis within the socket since the lower end of the push rod also nests in the concave top of a push rod (or valve) lifter. In these structures there is no actual mechanical linkage connection of either end of the push rod to any other part of the valve opening and closing mechanism. As a result, and as a consequence of the rapid, repeated impact force on the push rod receiving socket on the rocker arm, particularly at rpm's such as 9,000 or more, this socket is typically destroyed before its time as well as incurring premature breakage of the adjacent portions of the rocker arm.

Also inherent in prior rocker arm constructions, particularly wherein solid (non-hydraulic) lifters are employed is the loose contact of the push rod with the rocker arm especially in a cold engine. This looseness can cause the valves to open a lesser degree than optimum designed operating conditions require.

SUMMARY OF THE INVENTION

The present invention comprises a unique configuration of a rocker arm per se, intake or exhaust, of e.g., high strength and high performance machined or cast steel or stainless, wherein high stress areas are strengthened, a unique push rod per se, the combination of this rocker arm and the push rod, and this combination in use in an internal combustion engine. In the aforesaid combination a rotative bearing connection is provided between the upper end of the push rod and the rocker arm whereby the sudden, rapid, repeated and severe impact forces of the push rod end against the rocker arm are spread throughout a heavy duty bearing connection and are thus greatly diminished for each point of force between the push rod and the rocker arm.

BRIEF DESCRIPTION OF THE DRAWINGS

The invention will be further understood from the drawings herein and description, wherein the structures in the figures are not drawn to scale or in proportion to each other, wherein certain structures are cross-sectional or broken away for clarity, wherein certain structural portion are outline by jagged lines, and wherein.

In further explanation of the process or mechanical functioning that takes place in an internal combustion engine having the present push rod and rocker arm combination, the present change that is taking place is in the area where the push rod meets the rocker arm pivoting point and in the harmonic's of the rocker arm design.

In an internal combustion engine of conventional design the push rod tip (upper end) has either a ball or cup design, either in the push rod or the rocker arm. This design creates friction in the ball and cup area which is lubricated by oil coming through an oil passage through the push rod and oiling the ball and cup.

The present design does not function with a ball and cup design and essentially eliminates rubbing friction in this area of contact between the push rod and rocker arm in that it functions off of a fulcrum, rather than a ball and cup. The push rod and the adjuster (threaded push rod end) are all one unit. The push rod screws into a trunion shaft that serves as a fulcrum for the push rod and rocker arm in which the adjuster is locked in place with a locking nut. The trunion shaft is mounted into the rocker arm with caged needle roller bearings which are oiled by oil coming through the push rod and falling into a special design reservoir made into the rocker arm. This structure oils the trunion shaft and the main (mounting) shaft of the rocker arm.

The harmonic's of a standard roller rocker arm are such that the energy travels through the push rod and meets the rocker arm and makes a sudden change in the direction of the energy transmission to the valve and valve spring.

The present design as described more fully below with reference to FIG. 6, allows the force energy to travel through the push rod and into the rocker arm and then in a radius "r" to the valve and valve spring. This creates a smoother transfer of energy from the push rod through the rocker arm to the valve and valve spring. By way of this design the engine speed comes up more quickly in a shorter time cycle and essentially eliminates push rod and rocker arm damage.

DETAILED DESCRIPTION

Figure 14:
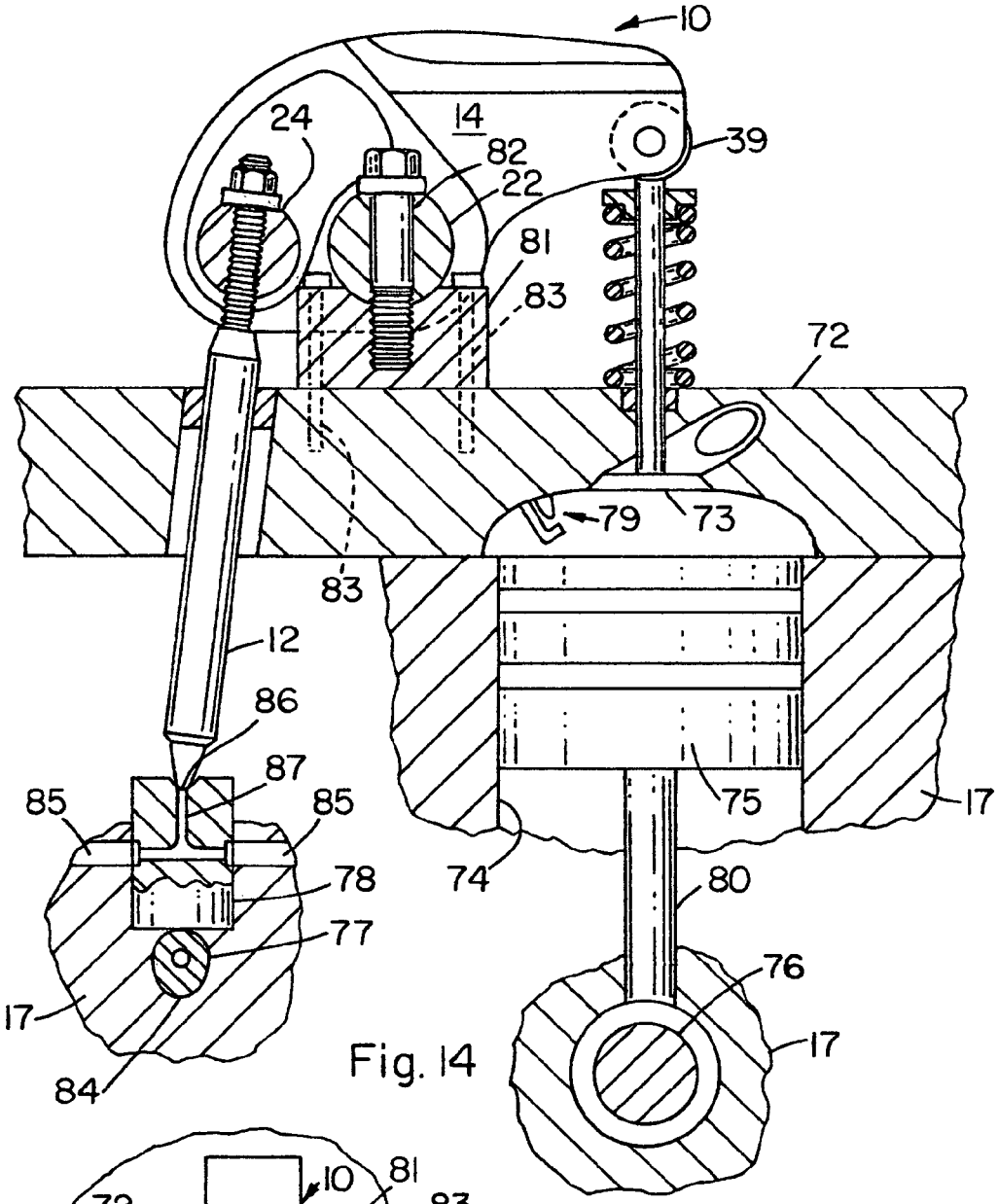
FIG. 14 is a mainly cross-sectional representation of portions of an internal combustion engine with a lifter and the present push rod and rocker arm combination mounted thereon wherein various engine structures are not in proportion or to scale and are meant to illustrate common features of an internal combustion engine.

The present invention will be understood further by reference to the drawings and claims herein, wherein the invention is defined in one of its broad embodiments as the combination of a rocker arm 10 and push rod 12, wherein the rocker arm comprises a body 14 having a longitudinal axis plane 15, a vertical axis plane 21, a valve stem contact end portion 16, a push rod connection end portion 18, and an intermediate section 20 which is provided with a pivot shaft 22 adapted for pivotally mounting the rocker arm on an engine head. Any convenient structure of this pivot shaft for mounting the ends 31 and 33 of the rocker arm on a particular head configuration can be employed, and FIG. 14 shows a preferred structure.

A trunion shaft 24 is rotatably mounted through bearing means 25 on end portion 18 and is adapted to be affixed in a set (but adjustable) position on the upper end 26 of the push rod 13 whereby pivoting of the arm 10 on the shaft 22 will cause the trunion shaft 24 to rotate and substantially maintain the axial posture 28 of the push rod. The plane 15 passes through the centers of shaft 22 and 24, and the plane 21 passes through the center of shaft 22 at a right angle to plane 15.

The upper end 26 of the push rod is threaded at 30, preferably machine threads, wherein the shaft 24 is provided with a bore 32 having threads 34 mating with threads 30 whereby the push rod can be screwed axially through bore 32 to adjust a valve lift distance, and wherein a lock nut 36 is threaded onto the upper end 26 and is adapted to tightly engage a flat 35 on shaft 24 and prevent rotation of the push rod within the bore 32. A washer 29 is preferably employed between the nut and the shaft.

The body end portion 18 is provided with interior wall means 37 forming an opening 38 generally vertically through body portion 18 and the trunion shaft is rotatably mounted generally laterally through said opening to expose upper portions 11 and 13 of walls means 37 to thereby form an oil reservoir 41 around shaft portions 40 which receives oil pumped through first passage mean 42 in the push rod A second oil passage means 44 is formed through body 14 and communicates with the reservoir 41 and the pivot shaft 22 for lubricating the same.

A roller 39 is rotatably mounted in bearing means 43 on a roller shaft 45 fixed in end portion 16 of the body and is adapted to contact the end 47 of a valve stem. A top portion of the body is formed with a cavity 46 which can become filled with oil which is pumped up through the push rod. A third oil passage means 48 is formed through the body and communicates with cavity 46 and the roller to lubricate the bearing means 43.

Each bearing means for mounting both the trunion shaft 24 and pivot shaft 22 preferably comprises a needle bearing such as generally designated 49 pressed into each end 50 and 52 of a shaft mounting bore 29 or 54. The shaft 24 is formed with an enlarged diameter center section 56 and reduced diameter end sections 58 and 60, wherein said center section slidably engages wall means 37 to form said oil reservoir 41. The junctions of the center section and end sections provide annular shoulders 62 and 64, wherein each cage 66 of the needle bearings bears against one of said shoulders. The needle bearing cages 66 are press fitted into bore 54 with the rollers 63 rollably engaging the end portions of shaft 24. An annular groove 68 is formed in each end section 58 and 60 and a snap ring 70 is positioned in each groove whereby an exceedingly strong mounting of the trunion shaft on the body is afforded.

Figure 1:
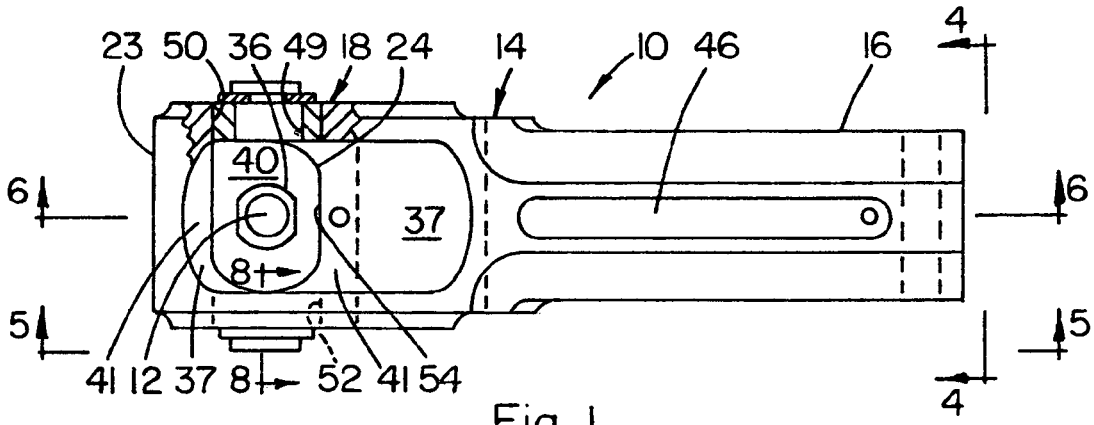
FIG. 1 is a top down view of the present rocker arm with certain structural portions broken away for clarity.
Figure 2:
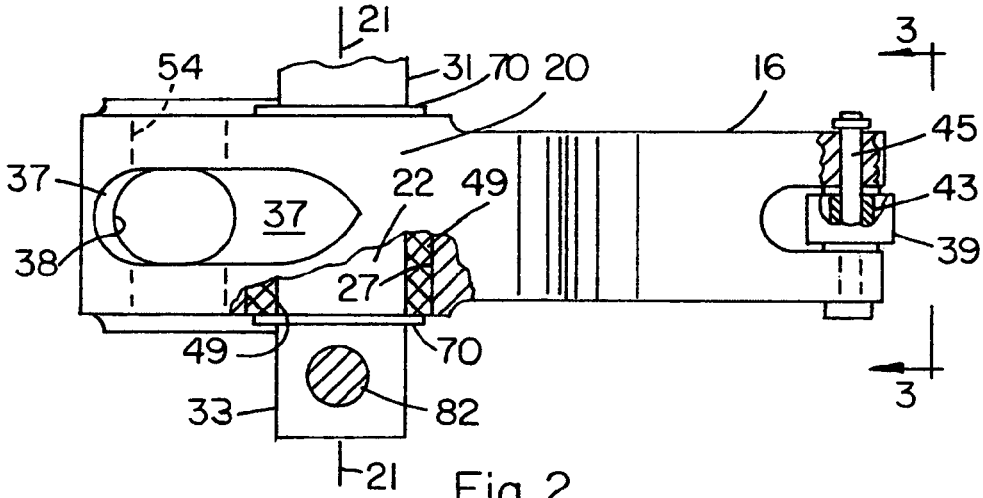
FIG. 2 is a bottom up view of the rocker arm of FIG. 1 also with certain structural portions broken away for clarity.
Figure 3:
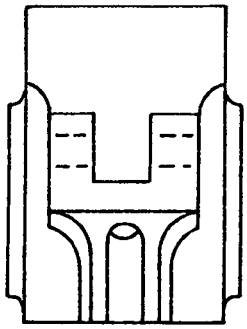
FIG. 3 is an end view of the rocker arm of FIG. 2 taken in the direction of 3-3 in FIG. 2 without any shafts shown.
Figure 4:
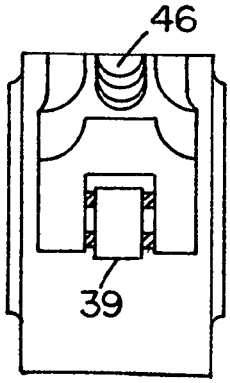
FIG. 4 is an end view of the rocker arm of FIG. 1 taken in the direction of 4-4 in FIG. 1 without any shafts shown.
Figure 5:
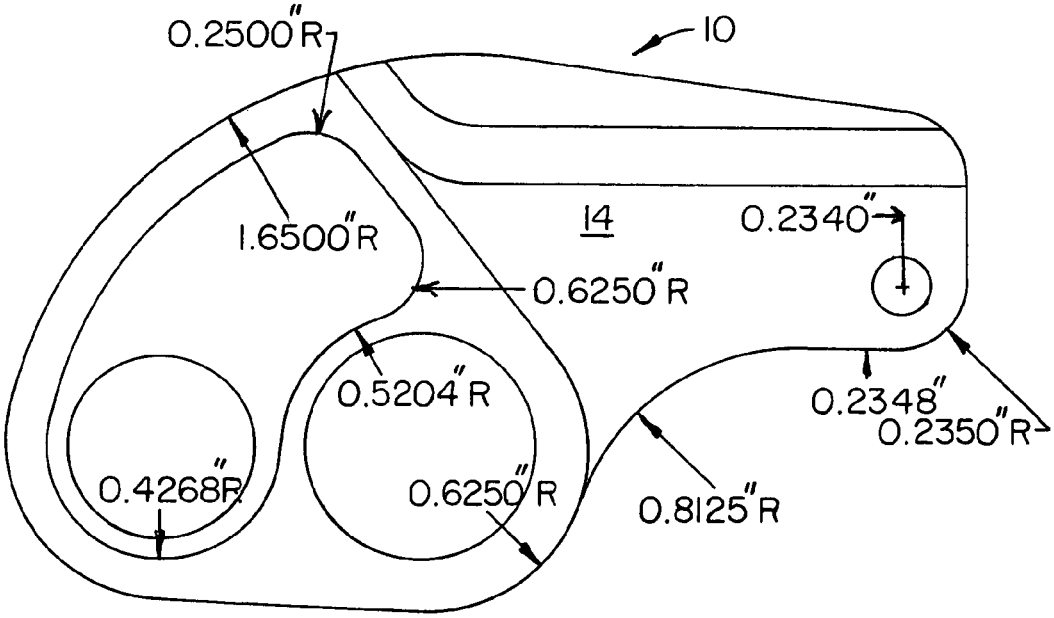
FIG. 5 is a side view of the rocker arm body (without shafts) of FIG. 1 taken in the direction of 5-5 therein.
Figure 6:
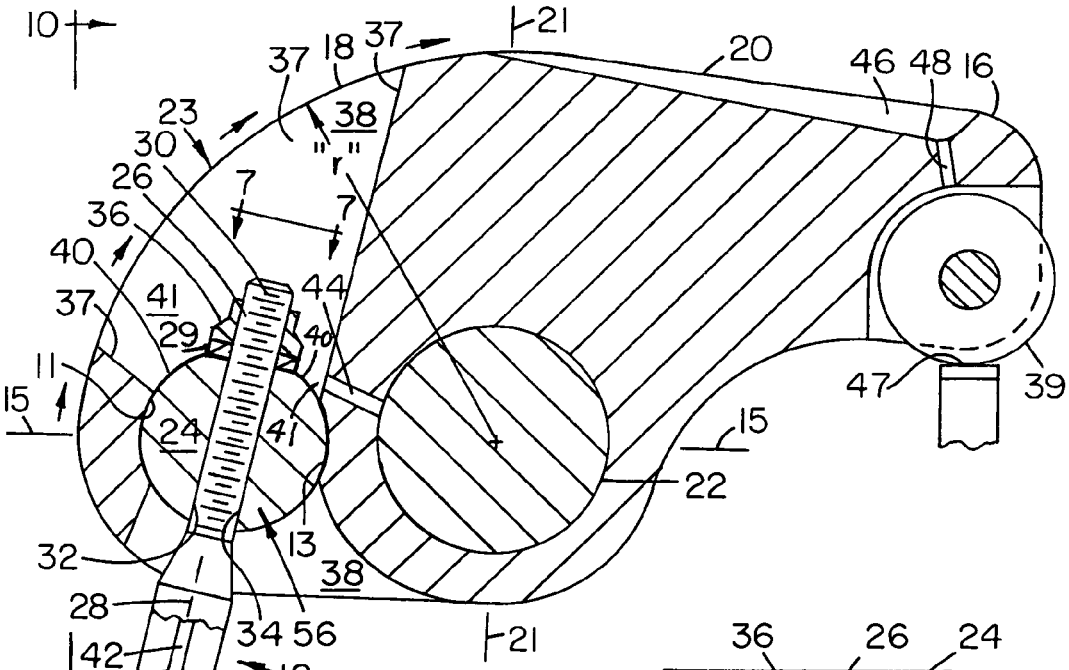
FIG. 6 is a longitudinal cross sectional view of the rocker arm of FIG. 1 with the upper portion of the present push rod mounted therein, as taken in the direction of 6-6 in FIG. 1.
Figure 7:
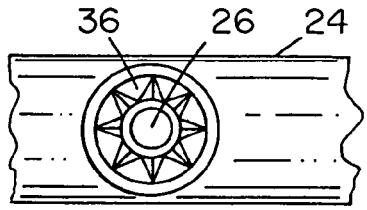
FIG. 7 is a top down view of the push rod-to-trunion shaft connection structure of FIG. 6 taken in the direction of 7-7 therein.
Figure 8:
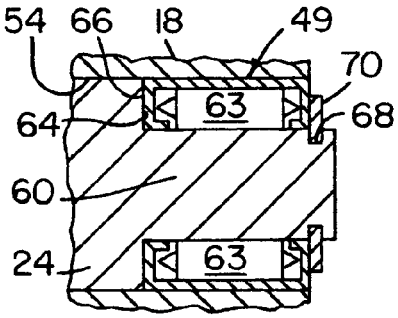
FIG. 8 is an enlarged cross-sectional view of the drawn-up needle roller bearing mounting for the end portion of the trunion shaft of FIG. 1 or the pivot shaft of FIG. 2, taken in the direction of 8-8 therein.
Figure 8A:
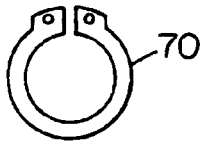
FIG. 8A is a side view of a snap ring structure useful in securing shafts herein to the rocker arm body.
Figure 9:
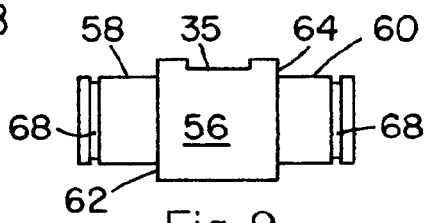
FIG. 9 is a side view of the trunion shaft of FIG. 1 showing the flat for the push rod position setting or locking nut.
Figure 10:
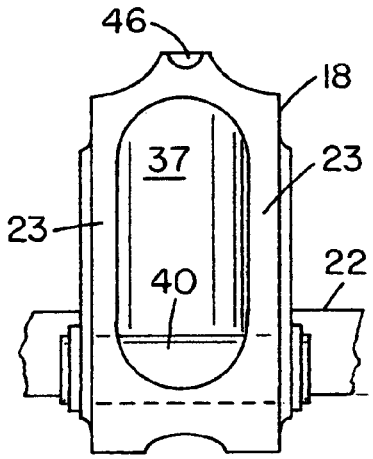
FIG. 10 is a front view of the rocker arm of FIG. 6 taken in the direction of line 10-10 therein without the push rod and pivot shaft shown.
Figure 11:
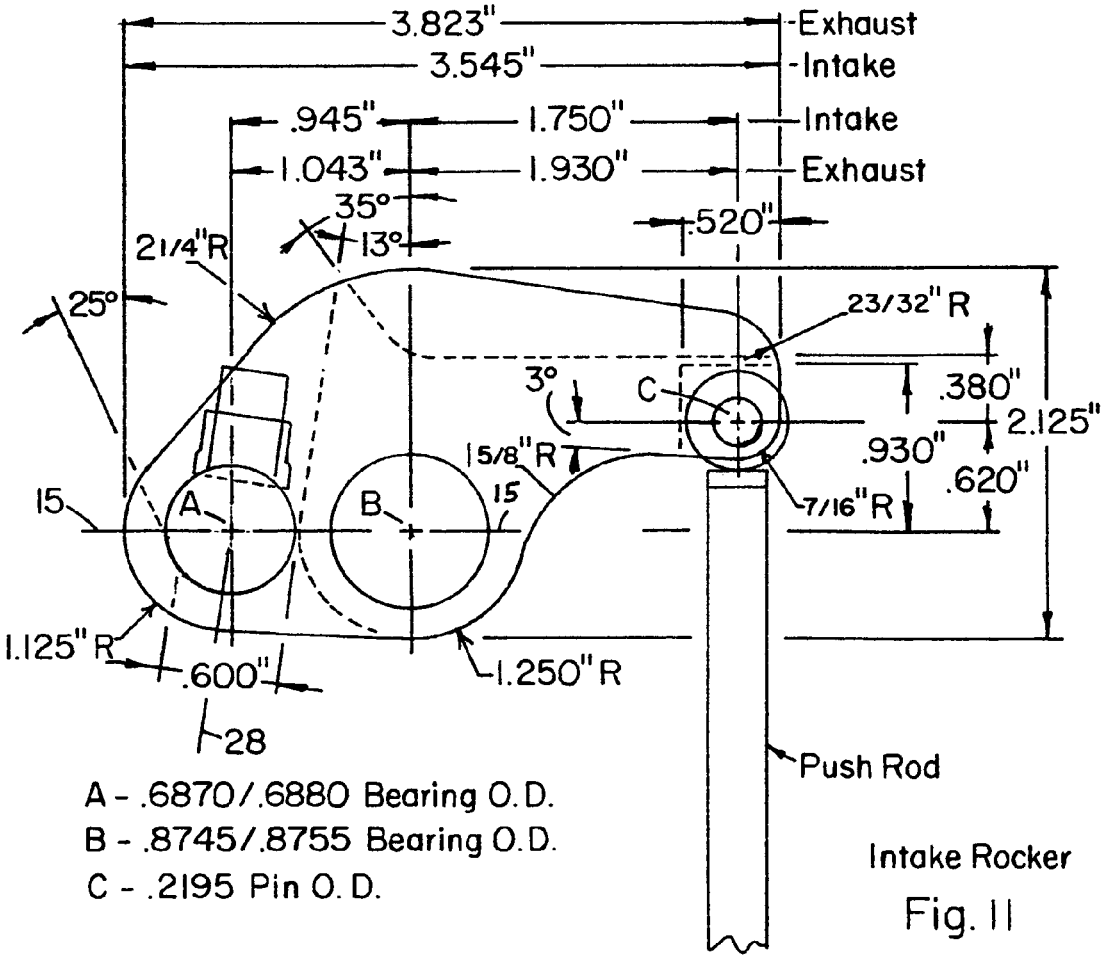
FIG. 11 is a schematic view of a typical rocker arm of the present invention with certain exemplary dimensions shown.
Figure 12:
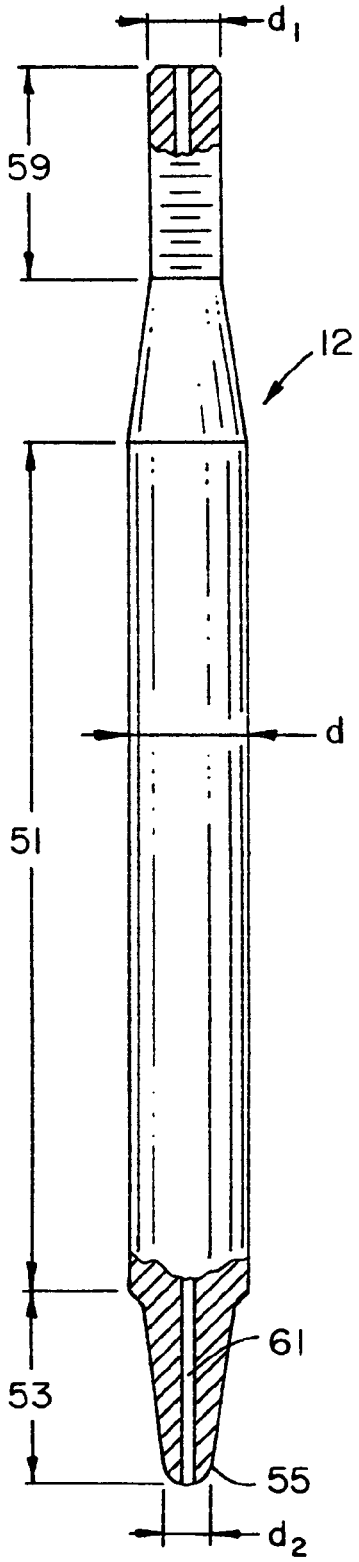
FIG. 12 is a side view of the present push rod structure with portions broken away for clarity.
Figure 13:
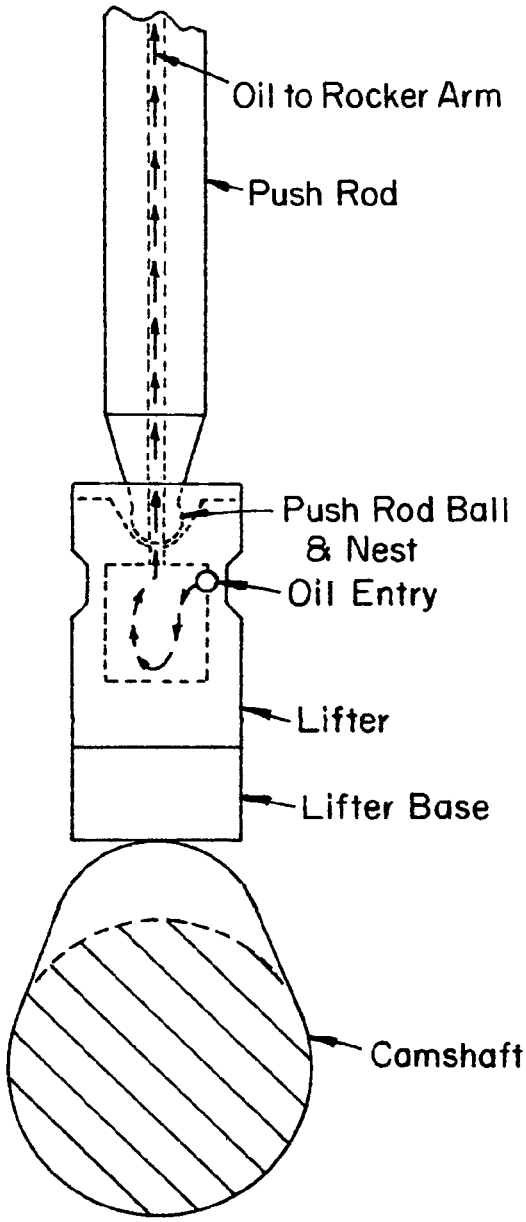
FIG. 13 is a side view of a typical mechanical lifter engaging a camshaft and employing the present push rod and showing the oil paths therethrough in arrowed line.

Referring to FIG. 6, an important aspect of the most preferred embodiment of the present invention is that at least about 60% and preferably from about 70% to about 85% of the mass of the present rocker arm (without shaft 22, push rod 12 and nut 36) lies above axis plane 15 of the body and provides greatly enhanced strength to the rocker arm as well as a relatively large mass through which force energy is more readily transmitted from the push rod to the valve stem. As seen further from FIG. 6, the configuration of the present rocker arm allows the push rod force energy to travel through the body in an arc or radius from the axis of pivot shaft 24 generally designated "r" as shown schematically by the dotted arrow lines in FIG. 6. Surface means 23 approximately defined by "r" preferably is substantially uniform, i.e., within about 10% of a completely uniform radius throughout the 90° quadrant between the longitudinal axis plane 15 and the vertical axis plane 21 of the rocker arm body.

The present unique push rod 12 comprises an elongated body portion 51, preferably round in cross-section and integral with a lower end section 53 having a rounded or similarly radiused end surface 55, and with an upper threaded end section 59. An oil passage 61 is provided completely through the rod in conventional manner. The ratio of the diameter "d" of said body portion 51 to the diameters "d", and "$d_2$" is preferably from about 1.2/1 to about 2.0/1 such that the body portion will not flex to any significant degree when under endwise pressure. Otherwise such flexing would alter the designed degree of value opening. In the embodiment shown, the total length of the push rod is approximately 11.5 in. and the length of body portion 57 is approximately 8.0 in.

In a comprehensive embodiment of the present invention, the present rocker arm and push rod combination is mounted on an internal combustion engine such as a typical V6, V8, or in line cylinder arrangement of any conventional design and number of cylinders. A typical such engine is the Chevrolet V8 engines shown in The Haynes Chevrolet Engine Overhaul Manual, Library of Congress Catalog Card Number 91-71154, the disclosures of which are hereby incorporated herein by reference in their entireties.

Figure 16:
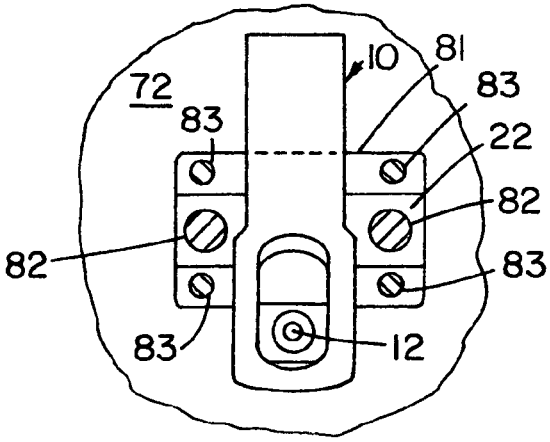
FIG. 16 is a top down view of the cylinder head of FIG. 14 with the present combination of push rod and rocker arm mounted thereon.
Figure 15:
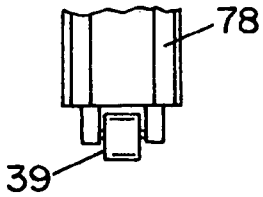
FIG. 15 is a view of a portion of a roller lifter, which portion can be used with solid (mechanical) or hydraulic lifters.

A schematic exemplary showing of portions of an internal combustion engine with the present rocker arm and push rod combination thereon is given in FIGS. 14 and 16 wherein, in a simplified form, the engine comprises an engine block 17, a cylinder head 72 mounted thereon, an exhaust (or intake) valve 73 mounted in said head, a cylinder 74 formed in said block, a piston 75 mounted in said cylinder and connected by a connecting rod 80 to a crankshaft 76 mounted in said block, a camshaft 77 with its lobes 84 mounted in said block and engaging a lifter 78 mounted in said block, and a spark plug 79 mounted through said head and communicating with said cylinder 74.

Each pivot shaft 22 for the present rocker arms is bolted by bolts 82 to a rocker arm stand generally designated 81 which is bolted by bolts 83 to head 72. Each lifter 78 is in communication with the pressurized lubrication lines 85 of the engine, and the top cap or push rod nest 86 thereof is provided with an oil passage 87 which feeds oil under pressure into oil passage 61 in the push rod.

This invention has been described in detail with particular reference to preferred embodiments thereof, but it will be understood that variations and modifications will be effected within the spirit and scope of the invention.

I claim:

1. The combination of a rocker arm and a push rod for use in an internal combustion engine, wherein said rocker arm comprises a body having a longitudinal axis plane, a valve stem contact end portion, a push rod connection end portion, and an intermediate portion which is provided with pivot means adapted for pivotally mounting the rocker arm on an engine head, wherein a trunion shaft is rotatably mounted in bearing means on said push rod connection end portion and is affixed in an adjustable set position on an upper end of said push rod, whereby pivoting of said arm on an engine head will cause said trunion shaft to rotate and substantially maintain an operative axial posture of the push rod, and wherein said push rod is externally threaded at its upper end, wherein said trunion shaft is provided with a bore having internal threads mating with the push rod threads whereby said push rod can be screwed axially through said bore to adjust a valve lift distance, and wherein a nut is threaded onto said upper end and adapted to tightly engage said trunion shaft and prevent untimely rotation of said push rod within said bore.

2. The combination of claim 1 wherein said push rod connection end portion connection end portion is provided with interior wall means forming an opening generally vertically through said connection end portion and wherein said trunion shaft is rotatably mounted generally laterally through said opening whereby upper portions of said trunion shaft and said nut are exposed, wherein central portions of said trunion shaft slidably engage portions of said wall means to thereby form an oil reservoir in which said upper portions lie, and wherein said reservoir is adapted to receive oil pumped up through first oil passage means in said push rod whereby the contacting surfaces of said trunion shaft and said body are substantially continually flooded with lubricant during engine operation.

3. The combination of claim 2 wherein second oil passage means is formed through said body and communicates with said reservoir and said pivot means for lubricating said pivot means.

4. The combination of claim 3 wherein a roller is rotatably mounted on a roller shaft fixed in said contact end portion of said body and is adapted to contact the end of a valve stem, wherein a top portion of said body is formed with a cavity which becomes filled with oil which is pumped up through said push rod, and wherein third oil passage means is formed through said body and communicates with said cavity and said roller and roller shaft to provide substantially continuous lubrication therefor during engine operation.

5. The combination of claim 1 wherein said bearing means comprises a pair of needle bearings, each cage thereof being pressed into an end of a mounting bore for said trunion shaft in said body.

6. The combination of claim 5 wherein said trunion shaft is formed with an enlarged diameter center section and reduced diameter end sections, wherein said center section slidably engages said wall means to form said oil reservoir, wherein the junctions of said center section and end sections provide annular shoulders, wherein the cage of each needle bearing bears against a said shoulder, wherein an annular groove is formed in each said end section, and wherein a snap ring is positioned in each said groove and is adapted to bear against an adjacent surface of said body whereby an exceedingly strong and stable mounting of said trunion shaft on said body is afforded.

7. The combination of claim 1 wherein said body is configured to provide a substantially uniformly radiused surface means extending in a substantially uniform arc between a longitudinal axis plane and a vertical axis plane of said body, whereby an additional relatively large mass is afforded to said body above said longitudinal axis plane, and whereby push rod force energy can be transmitted through said body, generally along said arc.

8. In an internal combustion engine having an engine block with at least one cylinder formed therein, a cylinder head mounted on said block over the top of said cylinder, valve means mounted in said cylinder head and communicating with said cylinder, a piston mounted in said cylinder for reciprocation therein, and cam shaft means mounted in said block and engaging valve lifter means mounted in said block, the combination of a rocker arm and a push rod for said engine, said rocker arm being mounted on said head and said push rod being pivotally affixed to said rocker arm, wherein said rocker arm comprises a body having a longitudinal axis plane and a vertical axis plane and further having a valve stem contact end portion, a push rod connection end portion, and an intermediate portion which is provided with a pivot shaft for pivotally mounting the rocker arm on said head, wherein each end section of a trunion shaft is rotatably mounted in bearing means on said push rod connection end portion of said body and is affixed in an adjustable set position on the upper end of said push rod whereby pivoting of said rocker arm on said pivot shaft will cause the trunion shaft to rotate and substantially maintain the axial operative posture of the push rod during engine operation, and wherein the upper end of said push rod is externally threaded, wherein said trunion shaft is provided with a bore having internal threads mating with said threads on said push rod whereby said push rod can be screwed axially through said bore to adjust to a specified valve lift distance, and wherein a nut is threaded onto said upper end of said push rod and adapted to tightly engage said trunion shaft and prevent rotation of said push rod within said bore.

9. The engine of claim 8 wherein said push rod connection end portion is provided with interior wall means forming an opening generally vertically through said connection end portion and wherein said trunion shaft is rotatably mounted in said connection end portion generally laterally through said opening to expose upper portions of said trunion shaft and said nut, and wherein said trunion shaft slidably engages portions of said wall means to thereby form an oil reservoir around said upper portions which thereby receive oil pumped up through first oil passage means generally axially formed through said push rod.

10. The engine of claim 9 wherein second oil passage means is formed through said body and communicates with said reservoir and said pivot shaft.

11. The engine of claim 9 wherein a roller is rotatably mounted by bearing means on a roller shaft fixed in said contact end portion and is adapted to contact the end of a valve stem, wherein a top portion of said body is formed with a cavity which becomes filled with oil which is pumped through said push rod during engine operation, and wherein third oil passage means is formed through said body and communicates with said cavity and said roller to lubricate said bearing means.

12. The engine of claim 9 wherein each said bearing means comprises a needle bearing, the cage of which is pressed into an end and of a shaft mounting bore formed laterally through said body.

13. The engine of claim 12 wherein said trunion shaft is formed with an enlarged diameter center section and reduced diameter end sections, wherein said center section is slidably engaging said wall means to form said oil reservoir, wherein the junctions of said center section and end sections provide annular shoulders, wherein each cage of the needle bearings bears against a said shoulder, wherein an annular groove is formed in each end section, and wherein a snap ring is positioned in each said groove whereby an exceedingly strong mounting of said trunion shaft on said body is afforded.

14. The engine of claim 8 wherein said body is configured to provide a substantially uniformly radiused surface means on said connection end portion and extending in a substantially uniform arc between a longitudinal axis plane and a vertical axis plane of said body, whereby an additional relatively large mass is afforded to said body above said longitudinal axis plane, and whereby push rod force energy can be transmitted through said body generally along said arc.

* * * * *